United States Patent [19]

Reichert

[11] 3,990,732

[45] Nov. 9, 1976

[54] RELEASABLE THREAD CLAMP FOR A KNOTTING MACHINE

[75] Inventor: Kurt Reichert, Augsburg, Germany

[73] Assignee: Knotex Maschinenbau GmbH, Augsburg, Germany

[22] Filed: Sept. 24, 1975

[21] Appl. No.: 616,200

[30] Foreign Application Priority Data

Sept. 26, 1974 Germany ..... 2445922

[52] U.S. Cl. ..... 289/2; 28/49

[51] Int. Cl.[2] ..... A01D 59/04

[58] Field of Search ..... 28/49; 289/2

[56] References Cited

UNITED STATES PATENTS

| | | | |
|---|---|---|---|
| 1,305,706 | 6/1919 | Hathaway | 28/49 |
| 2,717,117 | 9/1955 | Felton | 28/49 |
| 2,977,144 | 3/1961 | Gegenschatz et al. | 289/2 X |

*Primary Examiner*—Louis K. Rimrodt

*Attorney, Agent, or Firm*—Woodhams, Blanchard and Flynn

[57] ABSTRACT

A releasable thread clamping device having a hollow knotter mandrel rotatable about its longitudinal axis and a knotter needle made of resilient material mounted within the knotter mandrel and supported for axial displacement relative to the knotter mandrel. The knotter needle has a free end which engages under tension the inner wall of the knotter mandrel. A lifting needle is provided and is supported for movement parallel to the longitudinal axis thereof and has adjacent its free end a first inclined surface extending at an acute angle relative to the longitudinal axis thereof. The knotter needle has a second inclined surface which is axially aligned with the first inclined surface on the lifting needle. A control mechanism is provided for effecting an axial shifting of the lifting needle to effect a movement of the first inclined surface into and out of engagement with the second inclined surface so that following an engagement of the first and second inclined surfaces, a continued movement of the lifting needle will effect an urging of the free end of the knotter needle away from the inner wall.

7 Claims, 4 Drawing Figures

3
13
2
1
1a
8
7
2
5
6
4
6.a

3
S
1a
2
6.

IV
3
a
2
6.
IV

RELEASABLE THREAD CLAMP FOR A KNOTTING MACHINE

FIELD OF THE INVENTION

This invention relates to a releasable thread clamp, in particular for a weave warp knotting machine, comprising a hollow knotter mandrel rotatable about its axis, and a knotter needle of a resilient material which is mounted within said knotter mandrel for axial displacement relative to the latter and which — by its hook provided at the free front end thereof— engages under tension with the inner wall of said knotter mandrel.

BACKGROUND OF THE INVENTION

In known thread clamping devices the knotter needle serves for drawing the two thread ends into the interior of the knotter mandrel during the end phase of the knotting operation and for holding said ends in said interior until the knot is tightened. To this end, it is known to impart a predetermined curvature to the front end of the knotter needle consisting of a resilient material so that the hook of the knotter needle is pressed under tension laterally in engagement with the inner wall of the knotter mandrel. Whilst the knotter needle is retracted into the knotter mandrel, the thread ends of the thread to be knotted then extend through between the needle hook and the inner wall of the knotter mandrel.

They are pressed-on in engagement with the inner wall of the knotter mandrel by the tension of the knotter needle so that a sufficiently great counter-tension for tightening the knot is produced in the thread ends. Yet when the knot is tightened then the thread ends must be completely drawn out from the knotter mandrel. At the same time, the hook of the knotter needle is firmly clamping the thread ends now as before. In known knotting devices the adjustment of the tension with which the hook of the knotter needle presses onto the thread ends is very difficult because this tension is, inter alia, also dependent upon the thickness and type of the material to be knotted. Heretofore, the tension of the knotter needle was adjusted to the thickness and type of the material to be knotted by a more or less great curvature of the front end of the knotter needle. To this end, the knotter needle was bent manually and to the feel, which however, in addition to both a great experience and skilfulness, also requires repeated tests and each time dismantling of the knotter needle. Particular difficulties were encountered during the adjustment of the tension of the knotter needle in the processing of boucle yarn and effect yarn because in the case of these yarn types either the tension of the knotter needle was too great and then the loops present in the yarn were ravelled or the tension was too small and then the knot was not sufficiently firmly tightened.

The problem underlying this invention is to provide a knotting device of the above-mentioned type, which is particularly suitable for knotting boucle and effect yarn and which is adjustable in a simple and time-saving manner to the type and thickness of the threads to be knotted.

According to the invention, this problem is solved in that within the knotter mandrel there is provided a further needle (lifting needle) which is arranged for axial displacement and at its front free end has an inclined surface extending under an acute angle relative to the axial direction, in that the knotter needle underneath its hook is provided with a corresponding inclined surface cooperating with said inclined surface of said lifting needle, and in that control means are provided which shift the lifting needle at an adjustable moment in the direction of its free end against the knotter needle and thus lift the hook thereof from the inner wall of the knotter mandrel.

Hence the invention starts off from the idea of lifting the hook of the knotter needle from the inner wall of the knotter mandrel at an adjustable moment to thereby wholly or partially eliminate the clamping effect between the hook and the inner wall and thus to clear the thread ends or again to also decrease the counter-tension acting upon the thread ends. Since the moment at which the hook of the knotter needle is lifted from the inner wall of the knotter mandrel is exactly adjustable in the novel knotting device, it is possible to control the more or less firm tightening of the knot according to each respective material so that in the case of tender yarns a damage of the yarns, in particular a ravelling of the loops in boucle and effect yarns, will be avoided. Since the adjustment of the time at which the hook of the knotter needle is lifted from the inner wall of the knotter mandrel does not depend upon the bending of any members but merely upon the axial position of the lifting needle, this can be achieved in a simple manner by suitable mechanical adjusting means.

BRIEF DESCRIPTION OF THE DRAWINGS

The invention will be described in greater detail hereinafter in the light of the exemplary embodiment shown in the drawings in which.

DETAILED DESCRIPTION

Figures 1, 2, 3:
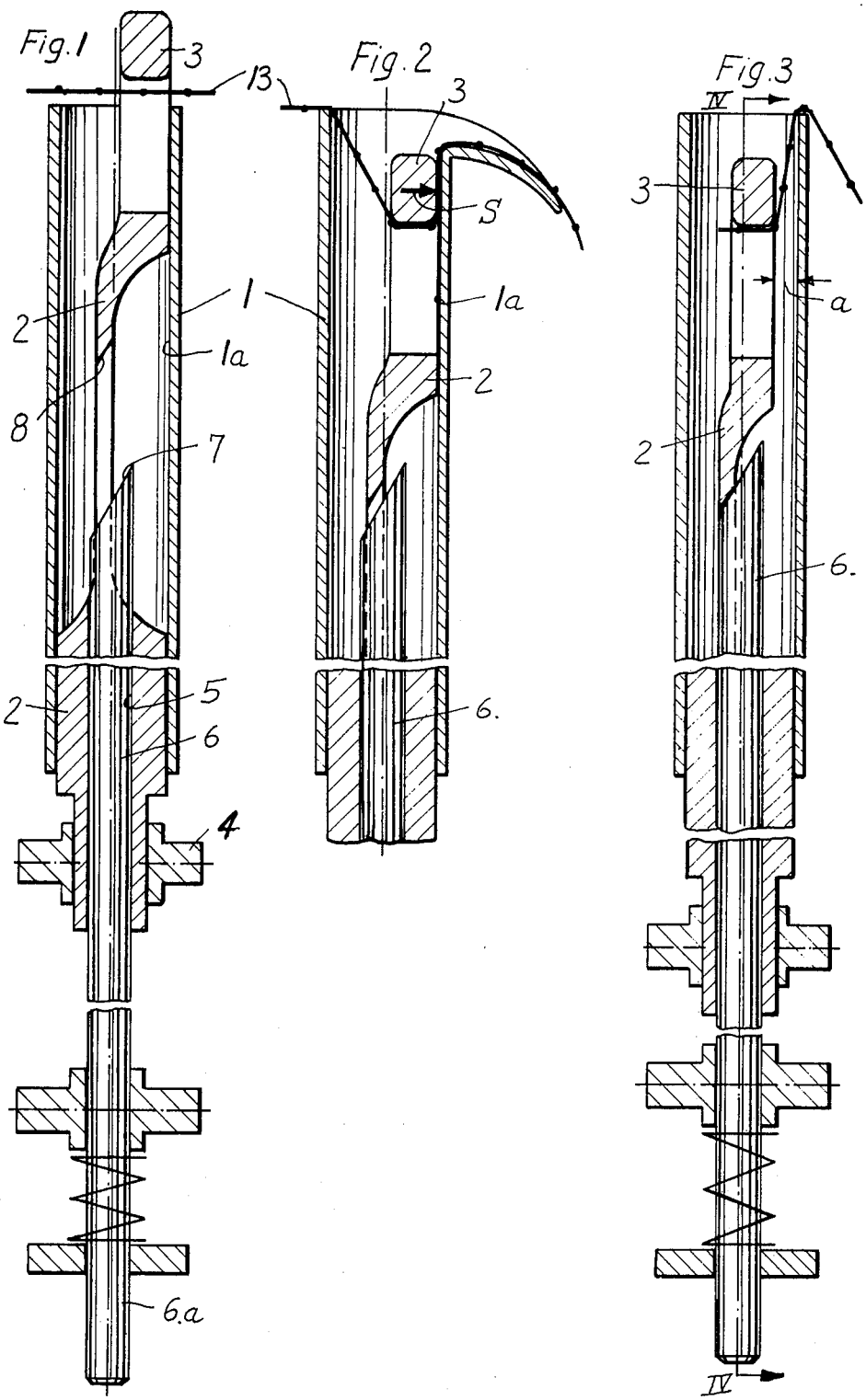
FIGS. 1 to 3 show a longitudinal sectional view of the novel knotting device in different operative positions.

In the drawing, 1 designates a hollow knotter mandrel rotatable in a known manner about its axis. The knotter needle 2 is axially shiftably mounted in the knotter mandrel. At its front free end the knotter needle carries a hook 3 in a known manner. At the rear end thereof a drive means (not shown) engages a hinge member 4. In the exemplary embodiment shown, the knotter needle 2 has a longitudinal bore 5 within which a lifting needle 6 is shiftably arranged. The longitudinal bore 5 simultaneously serves as a guide for the lifting needle 6.

At its free front end, the lifting needle 6 has an inclined surface 7 extending at an acute angle to the longitudinal axis thereof. The knotter needle 2 has a further inclined surface 8 underneath or rearwardly from the cooperating with the inclined surface 7. The front portion of the knotter needle 2 consisting of a resilient material is slightly sidewise bent relative to the axis of the knotter needle so that the hook 3 of the knotter needle engages the inner wall 1a of the knotter mandrel under a certain tension S (which fact cannot be seen from the drawing). As shown in FIGS. 1 to 3 of the drawings, the inclined surface 7 of the lifting needle 6 extends forwards in the direction of the inner wall 1a of the knotter needle 2 at which its hook 3 engages with the inner wall 1a of the knotter mandrel 1.

A shift fork 9 engaging the rear end 6a of the lifting needle 6 and a cam plate 10 driving the fork through a cam follower 15 on the fork are provided as the control means for the lifting needle 6. At the same time, the shift fork cooperates with a hinge member 12 shiftable on the end 6a of the lifting needle 6 and adapted to be adjusted or fixed by an adjusting screw 11.

OPERATION

The mode of operation of this novel knotting device is as follows:

The threads held in the usual manner by clamps (not shown) are wound — by the rotation of the knotter mandrel — round the mandrel. Then the hook 3 of the knotter needle does by axial shifting of the same emerge from the front end of the knotter mandrel 1 also in a manner known per se and engages the thread ends 13. Then the knotter needle moves back into the interior of the knotter mandrel 1 and draws the thread ends 13 into the knotter mandrel. Thus the thread ends 13 — as shown in FIG. 2 — are clamped by the force S between the knotter needle hook 3 and the inner wall 1a by the bias of the knotter needle. This clamping is necessary to permit the knot draw-out member to tighten the knot.

Figure 4:
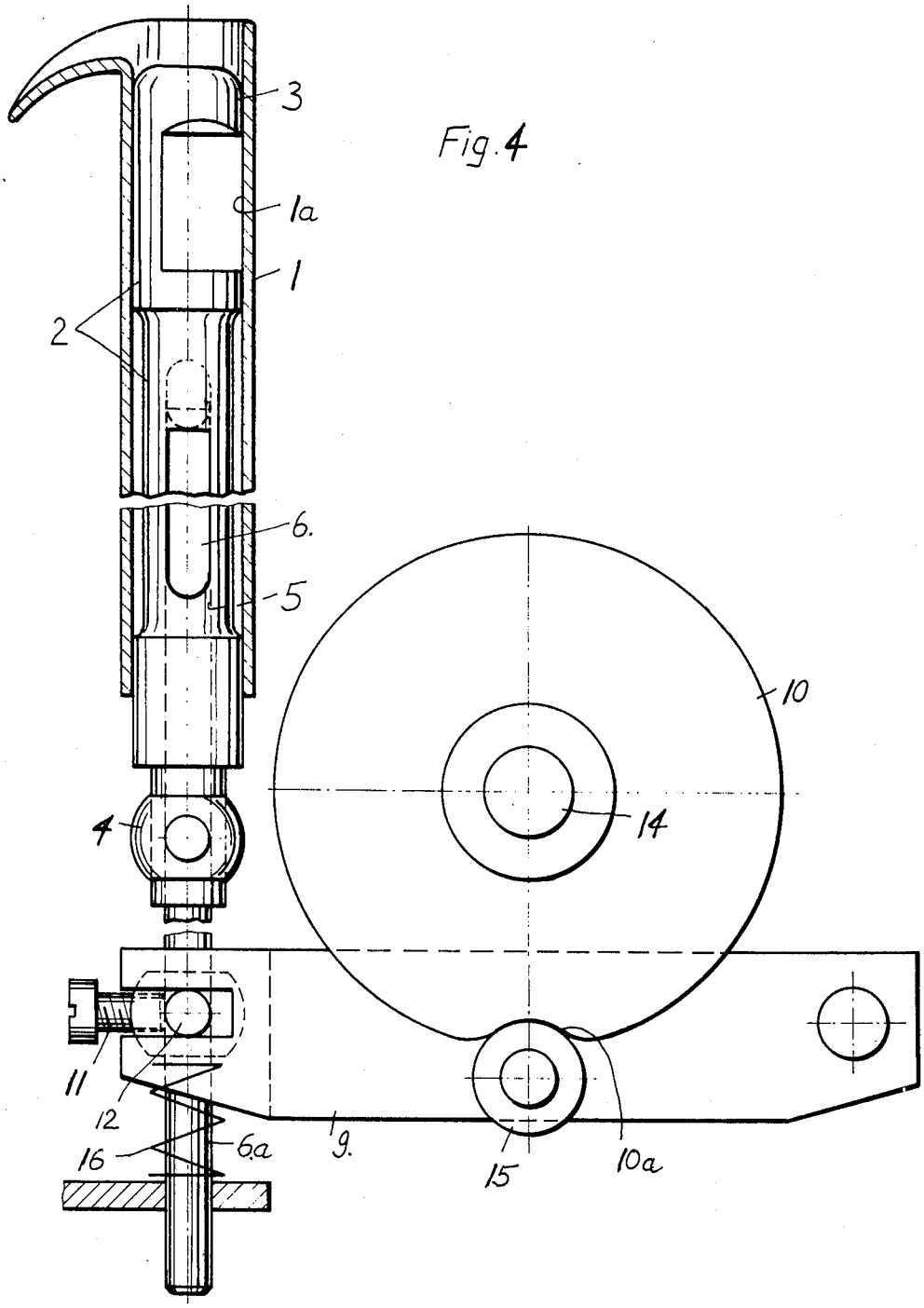
FIG. 4 shows a further longitudinal sectional view according to line IV—IV of FIG. 3.

During the entire knotting operation, the cam plate 10 arranged on the control shaft 14 which is common to all parts continues its rotation. At the moment at which approximately the knot is tightened, the cam plate 10 has reached the position shown in FIG. 4 in which the cam follower or roller 15 of the shift fork 9 drops into a depression 10*a* of the cam plate. Due to the force of spring 16, the lifting needle 6 is shifted in the direction of the forward end of the knotter mandrel. Due to the inclined surfaces 17, 8, the knotter needle 2 is moved sidewardly and thus, according to FIG. 3, its hook 3 is lifted away from the inner wall 1*a* of the knotter mandrel 1. The amount *a* (see FIG. 3) by which this lifting takes place as well as the exact point in time can be precisely adjusted by adjusting the hinge member 12. In the event that it would be necessary to adjust the time point at which the hook 3 of the knotter needle 2 is lifted in wider limits then it would be eventually also possible to achieve this by turning the cam plate 10 relative to the control shaft 14. Due to the lifting of the hook 3, the clamping between the hook and the inner wall 1*a* is eliminated and the threads can be drawn out from the knotter mandrel without any essential force. In the event that for some reason or other it would be also necessary that during the definite drawing-out also a small counter-force should be exerted upon the thread ends, then by virtue of a suitable axial adjustment of the lifting needle 6 it would be also possible to lift the hook 3 only a small amount from the inner wall 1*a*. Since the time point at which the knotter needle is lifted as well as the spacing a can be exactly adjusted, it is now possible to adjust a more or less firm tightening to each respective type of yarn material used.

The embodiments of the invention in which an exclusive property or privilege is claimed are defined as follows:

1. A releasable thread clamping device for a cyclical knotting machine, comprising a hollow knotter mandrel rotatable about its longitudinal axis, a knotter needle of resilient material mounted within said knotter mandrel and supported for axial displacement relative to said knotter mandrel, said knotter needle having a hook at the free front end thereof which engages under tension the inner wall of said knotter mandrel to clamp a thread therebetween, a lifting needle supported for movement parallel to the longitudinal axis thereof and has adjacent its front free end a first inclined surface extending at an acute angle relative to said longitudinal axis thereof, said knotter needle having a second inclined surface axially aligned with said first inclined surface on said lifting needle, and control means for effecting an axial shifting of said lifting needle to effect a movement of said first inclined surface into and out of engagement with said second inclined surface whereby following an engagement of said first and second inclined surfaces a continued movement of said lifting needle will effect an urging of said free end of said knotter needle away from said inner wall to release said thread clamped therebetween.

2. A releasable thread clamping device according to claim 1, wherein said knotter needle has a longitudinal bore therein and wherein said lifting needle is shiftably arranged in said longitudinal bore.

3. A releasable clamping device according to claim 1, wherein said control means includes a shift fork engaging the rear end of said lifting needle and a rotatable cam plate operatively engaging said fork and driving said fork and, consequently, effecting said movement of said lifting needle.

4. A releasable clamping device according to claim 3, wherein said shift fork is operatively connected to said lifting needle through a hinge piece and means for selectively positioning and fixing said hinge piece on said lifting needle.

5. A releasable clamping device according to claim 4, wherein said means for selectively positioning and fixing said hinge piece is located adjacent an end of said lifting needle remote from said second inclined surface.

6. A releasable clamping device according to claim 5, wherein said means is a set screw.

7. A releasable clamping device according to claim 1, including adjustment means for adjusting the moment in time in a cycle of operation of said knotting machine that said first inclined surface engages said second inclined surface, and consequently, the moment in time that said free end of said knotter needle is urged away from said inner wall of said knotter mandrel.

* * * * *